United States Patent [19]

Garcia-Mallol et al.

[11] Patent Number: 4,682,567

[45] Date of Patent: Jul. 28, 1987

[54] FLUIDIZED BED STEAM GENERATOR AND METHOD OF GENERATING STEAM INCLUDING A SEPARATE RECYCLE BED

[75] Inventors: Juan A. Garcia-Mallol, Morristown; Michael G. Alliston, Denville, both of N.J.

[73] Assignee: Foster Wheeler Energy Corporation, Livingston, N.J.

[21] Appl. No.: 864,349

[22] Filed: May 19, 1986

[51] Int. Cl.[4] ..... F22B 1/02

[52] U.S. Cl. ..... 122/4 D; 110/245

[58] Field of Search ..... 122/4 D; 110/245, 244; 431/170

[56] References Cited

U.S. PATENT DOCUMENTS

| | | | |
|---|---|---|---|
| 3,823,693 | 7/1974 | Bryers et al. | 110/244 |
| 4,184,455 | 1/1980 | Talmud et al. | 110/245 |
| 4,250,839 | 2/1981 | Daman | 122/4 D |
| 4,349,969 | 9/1982 | Stewart et al. | 110/245 |
| 4,355,601 | 10/1982 | Hattiangadi | 122/4 D |
| 4,469,050 | 9/1984 | Korenberg | 110/245 |
| 4,473,033 | 9/1984 | Strohmeyer, Jr. | 110/245 |
| 4,476,816 | 10/1984 | Cannon et al. | 122/4 D |
| 4,594,967 | 6/1986 | Wolowodiuk | 122/4 D |

*Primary Examiner*—Henry C. Yuen

*Attorney, Agent, or Firm*—Marvin A. Naigur; Warren B. Kice

[57] ABSTRACT

A fluidized bed steam generator and method of generating steam including a separate recycle bed in which a plurality of vertically stacked fluidized beds are disposed in a furnace enclosure and a heat recovery enclosure is defined adjacent the furnace enclosure for receiving the effluent gases from the fluidized beds. A fluidized bed is defined in the heat recovery enclosure and one or two separators are provided adjacent the heat recovery enclosure for receiving the effluent gases and separating the entrained solid particles therefrom. The separated solid particles are then injected into the fluidized bed in the heat recovery enclosure. Fresh fuel is supplied to the recycle bed and the material inventory and fluidizing velocity in the recycle bed is controlled.

5 Claims, 1 Drawing Figure

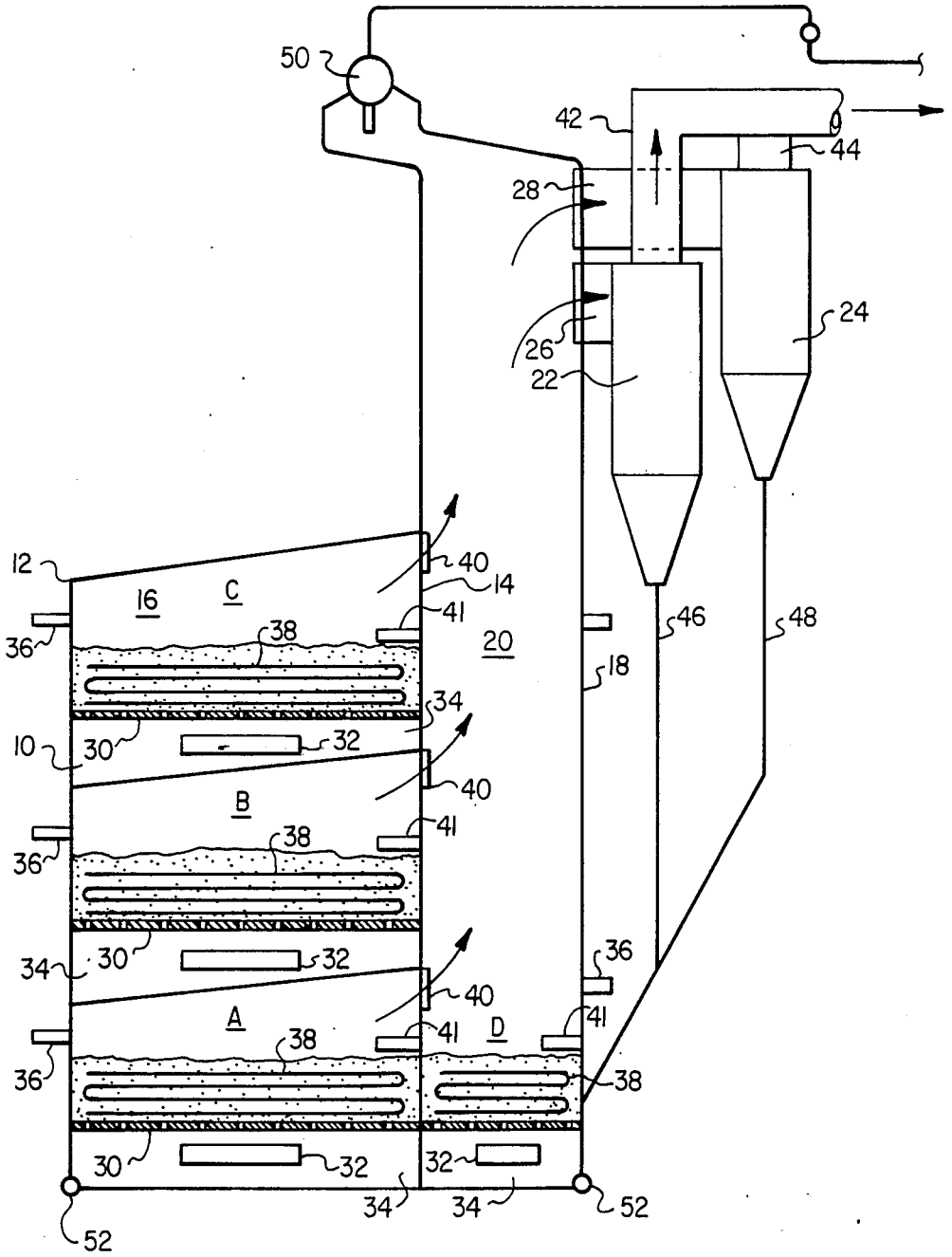
50
42
44
28
24
26
22
12
16
C
40
14
41
20
36
38
18
46
48
34
10
30
32
B
40
41
36
38
34
30
32
36
40
A
41
D
41
36
38
38
30
32
32
34
34
52
52

FLUIDIZED BED STEAM GENERATOR AND METHOD OF GENERATING STEAM INCLUDING A SEPARATE RECYCLE BED

BACKGROUND OF THE INVENTION

This invention relates to a fluidized bed heat exchanger and a method of generating steam, and, more particularly to such a generator and method in which a plurality of fluidized beds are provided for generating heat.

Fluidized beds are well recognized as attractive heat sources since they enjoy the advantages of an improved heat transfer rate, while permitting a reduction in corrosion, boiler fouling, and sulfur dioxide emission. In a typical fluidized bed arrangement, air is passed upwardly through a mass of particulate material causing the material to expand and take on a suspended or fluidized state. However, there is an inherent limitation on the range of heat input to the water passing in a heat exchange relation to the fluidized bed, largely due to the fact that the quantity of air supplied to the bed must be sufficient to maintain same in a fluidized condition yet must not cause excessive quantities of the particulate material to be blown away.

This disadvantage is largely overcome by the heat exchanger disclosed in U. S. Pat. No. 3,823,693 issued to Bryers and Shenker on July 16, 1974, and assigned to the same assignee as the present application. In the arrangement disclosed in the latter patent, the furnace section of the heat exchanger is formed by a plurality of vertically stacked chambers, or cells, each containing a fluidized bed. The fluid to be heated is passed upwardly through the fluidized beds in a heat exchange relation thereto to gradually raise the heat content of the fluid. A tube bundle is located in the area above each bed to provide a convection surface for the effluent gases from each bed. The particulate material is separated from the effluent gases exiting from the beds and recycled back into the lowermost bed which functions as a recycle cell to burn off the remaining carbon in the particulate material.

However, the fraction of flow area available above each bed to receive the tube bundles is relatively small due to limitations placed on the cross-sectional area of each cell caused by tube spacings, welding accessibility, combustion requirements, etc. As a result, the convection surface defined by the tube bundles is limited to an extent that the mass flow of the effluent gases per area of convection surface and the resulting heat transfer coefficient above each bed, is less than optimum. Also since the recycle bed is not provided with fresh fuel, undesirable variations in heat input due to fuel variations or steam generator output changes are often encountered. Further, there is no provision to control the inventory and the fluidizing velocity in the recycle cell, which further adds to the problems of controlling the heat in the beds.

SUMMARY OF THE INVENTION

It is therefore an object of the present invention to provide a steam generator and a method for generating steam which enjoys the advantages of stacked fluidized beds, yet provides a convection heat transfer surface of optimum size.

It is a further object of the present invention to provide a steam generator and method of the above type in which fresh fuel is supplied to the recycle bed to prevent undesirable variations in heat input.

It is a still further object of the present invention to provide a steam generator and method of the above type in which the inventory and the fluidizing velocity in the recycle bed are controlled.

Toward the fulfillment of these and other objects, a plurality fluidized beds are disposed in a furnace enclosure, and a heat recovery enclosure is defined adjacent the furnace enclosure for receiving the effluent gases from the fluidized beds. A fluidized bed is defined in the heat recovery enclosure and one or more separators are provided as needed, adjacent the heat recovery enclosure for receiving the effluent gases and separating the entrained solid particles therefrom. The separated solid particles are then recycled back into the fluidized bed in the heat recovery enclosure. Fresh fuel is supplied to the recycle bed and the material inventory and fluidizing velocity in the recycle bed are controlled.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings which is a schematic, vertical sectional, view of the steam generator of the present invention.

DESCRIPTION OF THE PREFERRED EMBODIMENTS

The steam generator of the present invention is shown in the drawing, and includes a furnace section formed with three primary fluidized bed cells A, B, and C extending in a chamber 10 defined by a front wall 12, a rear wall 14, a side wall 16, and another side wall not shown. The details of each bed cell A, B, and C will be described later.

An additional wall 18 is disposed in a spaced relation to the rear wall 14 to form a chamber 20 adjacent the chamber 10. A pair of cyclone separators 22 & 24 are disposed adjacent the wall 18 and communicate with the chamber 20 via ducts 26 & 28, respectively.

Three horizontal, perforated, air distribution plates 30 are disposed in a vertically spaced relation between the walls 12 and 14 and extend within the bed cells A, B, and C, respectively. An air inlet 32 (shown in cross-section) is associated with each bed cell A, B, and C and extends through the side wall 16 into an air plenum chamber 34 extending below each of the plates 30. As a result, air is distributed into each bed cell A, B, and C, with the flow being controlled by dampers, or the like (not shown).

Three spreaders 36 are mounted on the front wall 12 at three elevations and communicate with the bed cells A, B, and C, respectively. The spreaders 36 are adapted to receive particulate fuel from an external source, and discharge same into each bed cell in a conventional manner. It is understood that drop pipes, or the like (not shown) may be provided for feeding an adsorbent, such as limestone, into their respective bed cells A, B, and C for adsorbing the sulfur generated as a result of the combustion of the particulate fuel, in a conventional manner. The particulate materials thus form a bed of material in each bed cell A, B, and C which is fluidized by the air passing upwardly through the plates 30 and into each bed.

A tube bundle 38 is disposed immediately above the plates 30 and within the fluidized bed formed in each bed cell A, B, and C. Each tube bundle is connected to a system (not shown) for circulating water or steam through the tubes to remove heat from the fluidized beds in a conventional manner. It is understood that appropriate headers, downcomers, and the like (not shown), are provided for circulating water or steam through each tube bundle 38 to transfer heat generated in the bed to the water or steam.

Three openings 40 are formed through the wall 14 at three elevations to enable the effluent gases generated in each bed cell A, B, and C to be discharged from the chamber 10 into the chamber 20. A fluidized bed cell D, is disposed in the lower portion of the chamber 20 and has an air inlet 32, an air chamber 34, a spreader 36, and an optional tube bundle 38 associated therewith, which function in the manner described above in connection with the cells A, B, and C. It is understood that drop pipes, or the like (not shown) may be provided for feeding an adsorbent. Also, an inventory control device, such as weir 41 is disposed in the cells A, B, C, and D which operates in a conventional manner to control the volume of particulate material in its respective cell.

The gases entering the chamber 20 from the bed cells A, B, and C, via the openings 40, and the gases from the bed cell D mix in the chamber 14 and rise by the induced draft to the upper portion of the latter chamber before exiting through the ducts 26 & 28 and into the cyclone separators 22 and 24, respectively.

The cyclone separators 22 and 24 operate in a conventional manner to separate the solid particulate material entrained therein from the gases. The relatively clean gases pass from the separator 22 through an outlet duct 42 to an external heat recovery area (not shown) and the clean gases from the separator 24 pass through an outlet duct 44 to the duct 42. It is understood that the heat recovery area includes a plurality of tube bundles for removing heat from the gases after which the gases pass to a tubular air heater, a baghouse, an induced draft fan and to a stack, all of which are conventional and thus not shown.

The separators 22 and 24 each include a hopper portion which collects the fine particles separated from the effluent gases and passes same into injector lines 46 & 48 which inject the particles back to the bed cell D. The particles in the bed cell D combine with the fresh fuel particle fed to the cell by its spreader 36 and the mixture is fluidized and combusted in a manner similar to the particulate coal in the fluidized bed cells A, B, and C, as described above.

It is understood that the walls 12, 14, 16 and 18 are each formed by a plurality of vertically extending tubes connected in a conventional manner to form part of a natural circulation flow circuit which includes a steam drum 50, a plurality of headers such as shown by the reference numeral 52 at the ends of the above walls 12, 14, 16, and 18 and the tubes forming the latter walls. Since this type of arrangement is conventional it will not be described in any further detail. In operation, air is passed into each fluidized bed disposed in the bed cells A, B, and C to fluidize each bed, it being understood that the velocity and rate of flow of the air is regulated so that it is high enough to fluidized the particulate fuel and to obtain economical burning, or heat release rates, per unit area of bed, yet is low enough to avoid the loss of too many fine fuel particles from the bed and to allow sufficient residence time of gases for good sulfur removal by the adsorbent added to the bed. The heated air, after passing through each fluidized bed, combines with the combustion products from the bed and the resulting mixture, or gas (hereinafter referred to as the effluent gases) exits through the openings 40 in the wall 14 and flows into the heat recovery chamber 20. The effluent gases from the bed cell D, along with the gases from the cells A, B, and C, rise by the induced draft in chamber 20, exit from the chamber through the ducts 26 & 28, respectively, and flow into the separators 22 & 24, respectively. The solid fuel and adsorbent particles entrained in the effluent gases are separated therefrom in the separators 22 & 24, with the gases exiting through the ducts 42 and 44 and into the heat recovery area. The separated particles, which include flyash and unreacted fuel and adsorbent are injected to the fluidized bed in the cell D, where they mix with the fresh fuel supplied by the spreader 36 associated with the latter cell. The fuel feed from the cell D spreader 36 is varied in order to control the temperature of the bed and the air velocity through the cell D is controlled so that the effluent gases passing through the latter cell are saturated to maintain the quantity of solids entrained by the latter gases and discharged from the cell D substantially constant. The velocity of the air from the inlets 32 to each bed cell A, B, C, and D is regulated, and the amount of material in the cells is carefully controlled by the weirs 41 to prevent any increases in inventory in the latter cell once an inventory sufficient to maintain steady conditions in the latter cell is attained.

Several advantages result from the foregoing. For example, the material handling equipment required in the system of the present invention is minimized, thus considerably reducing the cost of the entire steam generator. Further, the effluent gases in the chamber 20, have a relatively long residence time since they must travel the full height of the chamber 20 and are maintained at a temperature high enough to promote their combustion by the periodic addition of the hot fuel gases entering from the bed cells A, B, and C. Also, any sulfur dioxide entering the chamber 20 is further reacted with the fine adsorbent particles as the gases travel upwardly in the chamber, resulting in a maximum efficiency of sulfur capture and minimum adsorbent requirements to control sulfur dioxide emissions. Still further, the present invention enables construction of an extremely tall freeboard section above the bed cell D so as to insure the foregoing advantages. Still further the heat input remains substantially constant by virtue of the introduction of the fresh fuel material to the recycle bed, and the material inventory and the fluidizing velocity of the recycle bed are controlled to maintain steady conditions in the latter bed. Also the recycle rate can be controlled and maintained at high values for low load cyclone efficiency.

It is understood that changes may be made to the foregoing without departing from the scope of the invention. For example, the bed cells A, B, and C do not necessarily have to be vertically stacked, but rather can be placed in a side-by-side relationship. Also in certain situations it is not necessary to provide a bundle of heat exchanger tubes in the bed cell D, in which case the latter cell would function in the same manner as described, but without the heat removal provided by the tubes. Further, the number of separators can be increased as needed.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A steam generator comprising a furnace section, means in said furnace section for receiving a plurality of vertically spaced beds of particulate fuel material, means for introducing air into said beds to fluidize said beds and promote the combustion of said fuel material, means for introducing additional fuel to each of said beds, the effluent gases from each of said beds rising upwardly into the areas above said beds, one boundary wall of said furnace section having openings therein for permitting the discharge of effluent gases from said areas above said beds, a heat recovery enclosure disposed adjacent said furnace section, said boundary wall serving as a common wall between said furnace section and said enclosure so that said enclosure receives said discharged effluent gases, means for receiving a bed of particulate fuel material in said enclosure extending to the side of the lowest of said vertically spaced beds, means for introducing air into said bed in said enclosure to fluidize and promote the combustion of said fuel material in said latter enclosure, means for adding additional fuel material to said fluidized bed in said enclosure, the effluent gases from said enclosure combining with the effluent gases from said furnace section, the height of said enclosure being greater than that of said furnace section so that the effluent gases in said enclosure pass upwardly through said enclosure for a distance greater than the height of said furnace section, means disposed adjacent said enclosure for receiving said combined effluent gases from said enclosure and separating the entrained solid particles from said latter gases, and means for injecting the separated solid particles into the fluidized bed in said enclosure.

2. The steam generator of claim 1 further comprising means for controlling the amount of fuel added to said fluidized bed in said enclosure to control the temperature of said latter fluidized bed.

3. The steam generator of claim 1 further comprising means for controlling the level of particulate fuel material in each of said fluidized beds.

4. A method of operating a steam generator comprising the steps of establishing at least one bed of particulate material including fuel in a furnace, introducing air into said bed at a predetermined velocity to fluidize and promote the combustion of said material, adding additional particulate material including fuel to said bed, discharging effluent gases from said fluidized bed through a boundary wall of said furnace, said boundary wall serving as a common wall between said furnace and a heat recovery enclosure for receiving said discharged effluent gases, establishing a bed of particulate material including fuel in said enclosure, introducing air into said bed in said enclosure to fluidize and promote the combustion said fuel material in said enclosure, adding additional fuel material to said fluidized bed in said enclosure, combining in said enclosure the effluent gases from said bed in said enclosure and the effluent gases from said furnace, passing said combined gases through said enclosure for a distance which exceeds the height of said furnace section, separating the entrained solid particles from said combined gases, injecting the separated solid particles into the fluidized bed in said enclosure, and controlling the amount of material in said fluidized bed in said enclosure relative to said fluidizing velocity so that the combined gases in said enclosure are saturated with said material.

5. The method of claim 4 wherein the amount of fuel material entrained by said gases and injected into said enclosure is substantially constant.

* * * * *